United States Patent [19]

Miyamoto et al.

[11] 4,095,204

[45] June 13, 1978

[54] TRANSFORMER HAVING FORCED OIL COOLING SYSTEM

[75] Inventors: Teruo Miyamoto; Toshiji Ishii; Yoshikazu Miura; Tohei Nitta, all of Amagasaki, Japan

[73] Assignee: Mitsubishi Denki Kabushiki Kaisha, Tokyo, Japan

[21] Appl. No.: 649,271

[22] Filed: Jan. 15, 1976

[30] Foreign Application Priority Data

Jan. 27, 1975 Japan ..... 50-11708

[51] Int. Cl.[2] ..... H01F 27/12

[52] U.S. Cl. ..... 336/57; 29/602 R; 174/25 R; 336/58; 336/206; 428/922

[58] Field of Search ..... 336/206, 55, 57, 58, 336/94; 361/274; 428/922, 446; 162/138; 174/15 R, 16 R, 25 R, 120 FP; 29/602 R

[56] References Cited

U.S. PATENT DOCUMENTS

| | | | |
|---|---|---|---|
| 2,493,604 | 1/1950 | Walters | 336/206 |
| 2,943,134 | 6/1960 | Liao et al. | 174/16 R |
| 3,056,071 | 9/1962 | Baker et al. | 336/60 X |
| 3,340,446 | 9/1967 | Cox | 174/25 R |
| 3,440,587 | 4/1969 | Bartos et al. | 336/206 |
| 3,585,552 | 6/1971 | Feather et al. | 336/206 X |
| 3,780,206 | 12/1973 | Reynolds | 174/25 R X |
| 3,974,302 | 8/1976 | Croop et al. | 336/206 X |

FOREIGN PATENT DOCUMENTS

| | | | |
|---|---|---|---|
| 970,037 | 9/1964 | United Kingdom | 174/25 R |

*Primary Examiner*—Thomas J. Kozma
*Attorney, Agent, or Firm*—Oblon, Fisher, Spivak, McClelland & Maier

[57] ABSTRACT

A transformer having a forced air cooling system is disclosed. The transformer includes an insulating oil which is forcibly moved in the transformer and an insulating sheet which is partially covered with particles, fibers or other forms of an inorganic material for producing a static charge of opposite polarity to the charge produced by the base material of the insulating sheet caused by relative motion due to forced flow of the insulating oil.

11 Claims, 5 Drawing Figures

TRANSFORMER HAVING FORCED OIL COOLING SYSTEM

BACKGROUND OF THE INVENTION

The present invention relates to an electric apparatus containing insulating oil. More particularly, it relates to a transformer having a forced oil cooling system in which the generation of static electricity can be prevented with the forced flow of an insulating mineral oil. More particularly, a charge of static electricity produced by the flow of an insulating oil is prevented by modifying a surface of an insulating sheet in contact with the insulating oil by using a material which imparts static electricity having the opposite polarity.

When insulating oil is in contact with the surface of a solid, positive and negative charges in the oil are separated to form a double layer of the charges at the solid-liquid interface. When flow of the insulating oil occurs at the interface, the charge layer in the oil is conveyed by the flow of the oil and is separated from the charge on the surface of the solid which is of the opposite polarity. The amount of charge built up by the process is dependent on the rate of the charge separation and the rate of the relaxation of the charge to the ground. The rate of charge separation is higher for a lower value of resistivity of the insulating oil, while the relaxation of the charge decreases with the resistivity of the insulating oil. As a result, the charge produced by the flow of oil is highest in the range of $10^{12}$ to $10^{14}$ ohm-cm of volume resistivity of the insulating oil.

Most insulating mineral oils used for electric apparatus are included in the range of the volume resistivity so that the insulating mineral oils have a tendency to produce a high charge build-up. When the static electricity charge in the insulating mineral oil or on the solid exceeds a certain critical level, a discharge occurs which may cause failure of the apparatus.

Heretofore, it has been proposed to decrease the volume resistivity of oil to a value lower than $10^{12}$ ohm-cm by adding an ionic additive to prohibit the explosion hazard caused by the static charge build-up in the petroleum industry. However, it is not desirable to decrease the volume resistivity of oil since it causes inferior electric characteristics. From an industrial viewpoint, it is difficult to increase the volume resistivity of the insulating mineral oil to a value higher than $10^{15}$ ohm-cm purifying the insulating mineral oil in order to realize a volume resistivity which is not in the range of $10^{12}$ to $10^{14}$ ohm-cm.

Even though an insulating mineral oil having a volume resistivity of higher than $10^{15}$ ohm-cm is obtained at a specified temperature, the volume resistivity is easily decreased by deterioration or simply by a rise in temperature.

Accordingly, it is not desirable to control the volume resistivity of an insulating mineral oil for electric apparatus to prevent electrostatic charge build-up.

SUMMARY OF THE INVENTION

It is an object of the invention to provide a transformer having a forced oil cooling system in which a build-up of charge of static electricity due to the flow of an insulating oil is inhibited.

It is another object of the invention to provide a method of inhibiting a build-up of charge of static electricity due to the flow of an insulating oil in a transformer having a forced oil cooling system.

The foregoing and other objects are attained in accordance with one aspect of the present invention through the provision of a method of inhibiting a build-up of charge of static electricity due to the flow of an insulating oil in a transformer having a forced oil cooling system which comprises using an electric insulating sheet which is partially covered with particles of an inorganic material for producing a static charge of opposite polarity to the charge produced by the base material during relative motion due to a forced flow of the insulating oil.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

DETAILED DESCRIPTION OF THE PREFERRED EMBODIMENTS

Figure 1:
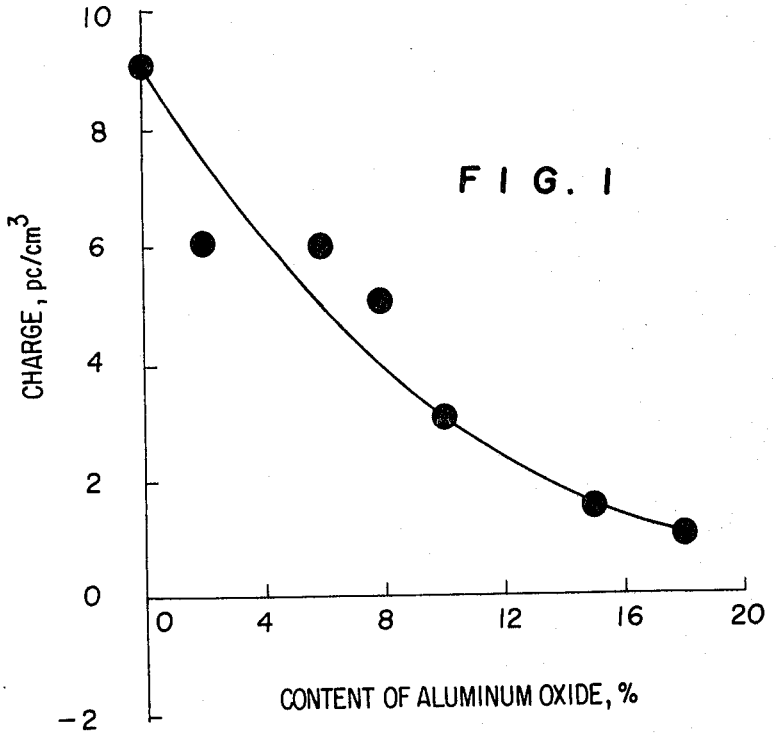
FIG. 1 is a graph showing the variation of the charges generated in each mineral oil to the amount of the particles of aluminum oxide mixed in each insulating sheet.
Figure 2:
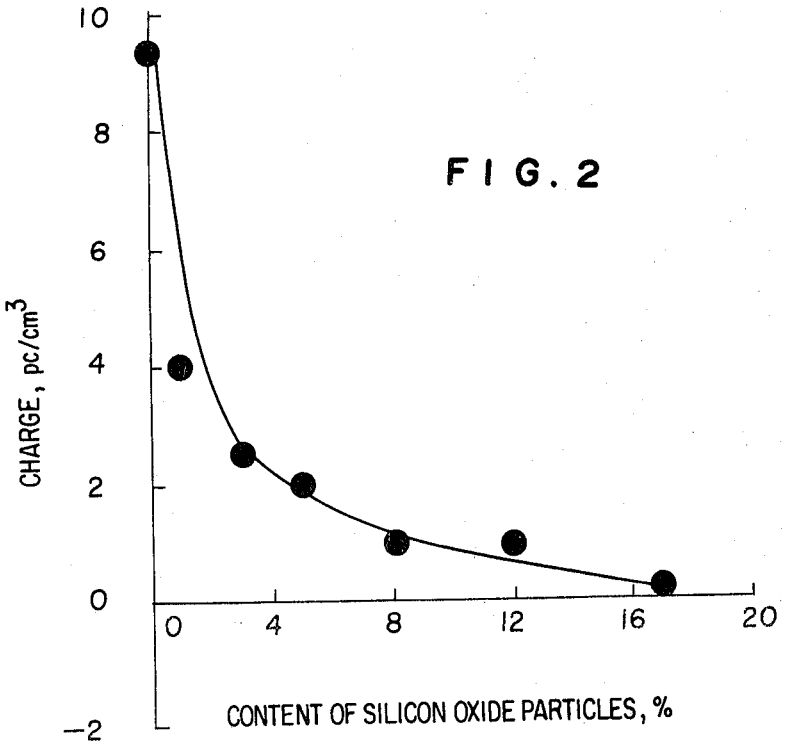
FIG. 2 is a graph showing the variation of the charges generated in each mineral oil to the amount of the particles of silicon oxide mixed in each insulating sheet.
Figure 3:
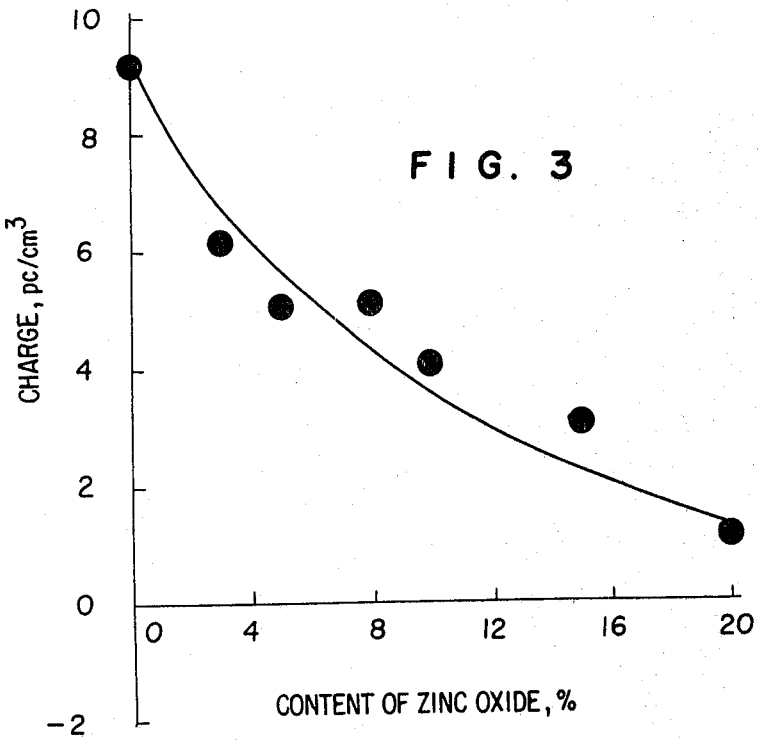
FIG. 3 is a graph showing the variation of the charges generated in each mineral oil to the amount of the particles of zinc oxide mixed in each insulating sheet.
Figure 4:
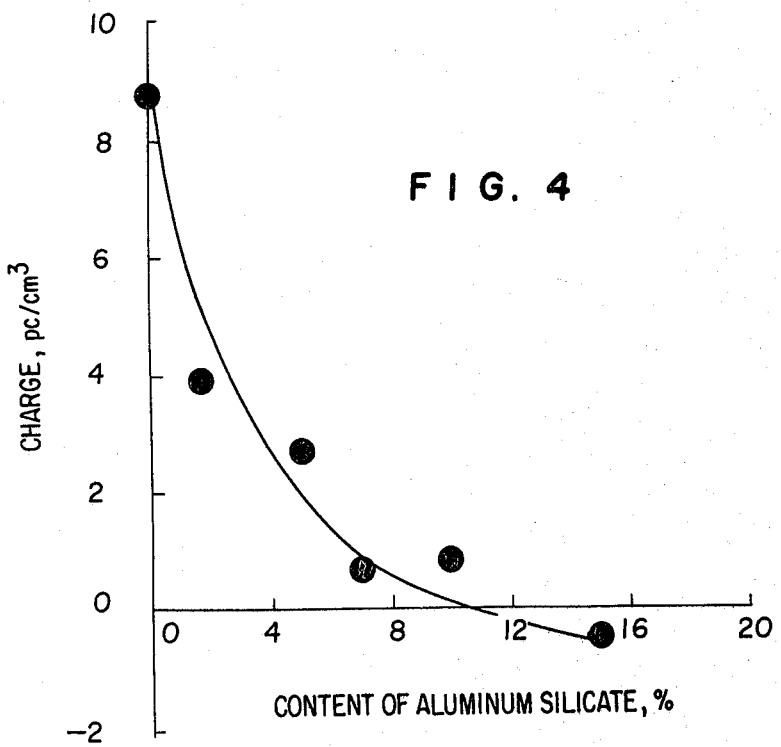
FIG. 4 is a graph showing the variation of the charges generated in each mineral oil to the amount of the particles of aluminum silicate mixed in each insulating sheet.

The same number of ions of positive and negative polarities normally exist in oil. When the oil is in contact with a solid, the ions of both polarities are adsorbed by the surface of the solid. The rate of the adsorption is higher for one polarity of ions than the other leaving an excess of ions of one polarity in the oil.

The separation of charges due to the flow of oil on the surface of the solid is caused by an interfacial ionic double layer which includes (1) an ionic layer formed on the surface of the solid by the difference of the adsorption forces of anions and cations (adsorption layer), and (2) an ionic layer in the oil having a polarity opposite to that of the adsorption layer formed by the diffusion of the charge left in the insulating oil (diffusion layer).

When a flow of the insulating oil is developed at the solid-liquid interface, the ions in the diffused layer are separated from the adsorption layer whereby the generation of static electricity may be observed. The polarity of the static electricity charged in the insulating oil is dependent upon the difference of the adsorption coefficients of anions and cations at the interface. When a material which generates a static charge of opposite polarity is mixed with the base material of an insulating sheet, the charge of the static electricity can be controlled. The present invention has been attained by the above-mentioned consideration.

Insulating sheets immersed in the insulating oil in electric apparatus are usually made of natural fiber such as kraft pulp, hemp, cotton and the like. When the insulating oil flows relative to the insulating sheet, the insulating oil has a positive charge. Inorganic materials such as oxides e.g. silicon oxide, aluminum oxide, zinc oxide, titanium oxide and the like and silicates e.g. aluminum silicate, magnesium silicate and the like can impart a negative charge by the flow of the insulating oil.

The charge of the static electricity of the insulating oil such as mineral oil, alkylbenzene and the like can be easily decreased by using insulating sheets having the inorganic materials on the surface of the sheets. The inorganic materials which impart a negative charge by the flow of the insulating oil can be placed on the surface of the insulating sheet by mixing it with the fiber during or after forming the insulating sheet. The inorganic materials can be mixed in the form of powder or fiber.

The amount of the inorganic materials is such as to impart a balanced negative charge by the flow of the insulating oil whereby the positive charge imparted by the relative motion between the fiber and the insulating oil is prevented by the negative charge imparted by the relative motion between the inorganic materials and the insulating oil.

The amount of the inorganic materials mixed with the natural fibers should be more than 1 wt.% preferably 5 to 30 wt.%. The surface layer may have a high content of the inorganic materials and the inner layer may have a low or zero content of the inorganic materials.

The inorganic materials are preferably mixed in the insulating sheet by blending the materials with the fiber in the step of forming the sheet such as in a beater or on a sheeting machine. It is especially desirable to concentrate the inorganic materials on one side of the surface of a thick pressboard by mixing the materials only in the laminar sheet at the surface of the pressboard on the sheeting machine.

These insulating sheets can be prepared by using precipitatable particles having a diameter of more than 0.005 micron meters, preferably more than 0.5 micron meters, or fibers whose diameter is more than 0.1 micron meters, preferably more than 1 micron meters, and mixing with a cellulosic fiber. Since the smaller the diameter of the particles or the thickness of the fibers means a larger surface area for a given weight content of the inorganic materials, the amount of the inorganic materials is strictly dependent on the size of the particles or the fibers. Less amount is needed for smaller size particles or thinner fibers.

Inorganic materials made of a polyvalent metal compound impart an effective negative charge, especially trivalent or tretravalent metal compounds such as an aluminum compound or a silicon compound impart an effective negative charge. The object of the invention can be attained by placing the inorganic materials only on the surface of the insulating sheet. Accordingly, the dielectric strength of the insulating sheet is not deteriorated. The polyvalent metal oxides, especially silicon oxide or aluminum oxide, have excellent electric characteristics. Accordingly, the electric characteristic of the insulating sheet can be improved by the materials mixed in the insulating sheet.

In a transformer having a forced oil cooling system, an insulating oil is caused to flow on the surface of the insulating sheet. If the particles of the inorganic material are separated from the insulating sheet to contaminate the insulating oil, an undesirable build-up of negative charge must be considered.

It is not preferable to bond particles of the inorganic material in or on the insulating sheet with a binder because the binder may cause contamination of the insulating oil. It is preferable to use paper having no additive which may contaminate the insulating oil. Accordingly, it is necessary to hold the particles of the inorganic material by the pulp fibrils so as to prevent flow-out from the insulating sheet.

Accordingly, it is preferably to use particles of inorganic material having a configuration which can be firmly held by the pulp fibrils. These particles are secondarily aggregated particles or particles which are aggregated in the insulating oil.

On the other hand, particles of the inorganic material having a high specific surface area can impart a relatively high effect to reduce the positive charge produced due to the flow of the insulating oil. Fine particles have a high specific surface area, however, and it is relatively difficult to hold fine particles in a paper without any binder. Aggregated particles formed by aggregation of fine particles have a high specific surface area and can be held in a paper.

Alumina gel, silica gel, silicate gel and other gel which constitute aggregated particles having a high specific surface area are preferably used in the invention. Aggregated particles of the gel having an average diameter of 0.1 -100 $\mu$ under microscope observation (aggregated particles) and having a true diameter of less than 1 $\mu$ (true particles) are preferably used. The aggregation of fine particles can be given in the insulating oil though it is preferable to form the aggregation in the paper manufacture so as to prevent a loss of the particles.

The gels such as alumina gel, silica gel and silicate gel can be produced by conventional methods such as wet methods. In the specification, the term gel denotes particles having a small diameter in a colloidal range as primary particles but having a relatively large diameter over the colloidal range as secondary particles in aggregated form.

It is also possible to blend fibrous inorganic material for producing a negative charge due to the flow of the insulating oil. Said fibrous inorganic materials include glass fiber, mica and fibrous ceramics.

The fibrous inorganic material can be held by pulp fibrils of the paper, and can be effectively exposed on the surface of the insulating sheet. When the aggregated particles of inorganic material or fibrous inorganic material are blended to pulp in a paper manufacture, and the resulting paper whose surface is partially covered with the inorganic material is used as an insulating sheet in a transformer having a forced oil cooling system, build-up of static charge and contamination of the insulating oil may be significantly retarded.

A further understanding of the invention can be obtained by the specific examples which are provided herein for purposes of illustration only.

EXAMPLES

In the conventional preparation of kraft paper for an insulating paper, aluminum oxide having an average diameter of 1 to 3 micron meters, silicon oxide having an average diameter of 0.3 micron meters, zinc oxide having an average diameter of 1 to 5 micron meters or aluminum silicate having an average diameter of 1 to 5 micron meters was mixed at the rate stated in FIGS. 1, 2, 3 and 4 in the sheeting process to form each sample of insulating paper having a thickness of 0.8 mm.

Each of the samples of the resulting insulating sheets was immersed in mineral oil having a resistivity of 2.4 $\times 10^{13}$ ohm-cm at 25° C and the mineral oil was flowing at a velocity of 10 cm/sec.. Each charge (pc/cm$^3$) generated in the mineral oil by the relative motion between the mineral oil and each insulating sheet was plotted in FIGS. 1, 2, 3 and 4.

FIGS. 1, 2, 3 and 4 are respectively graphs showing the variation of the charges generated in each mineral oil to the amount of the particles of aluminum oxide, silicon oxide, zinc oxide or aluminum silicate mixed in each insulating sheet. As is clear from the graphs, the charges generated in the mineral oil are quite small when an insulating sheet containing 10 to 30 wt.% of the particles is used. The charge of the static electricity of the insulating oil is dependent upon the resistivity and the flow velocity of the insulating oil.

Figure 5:
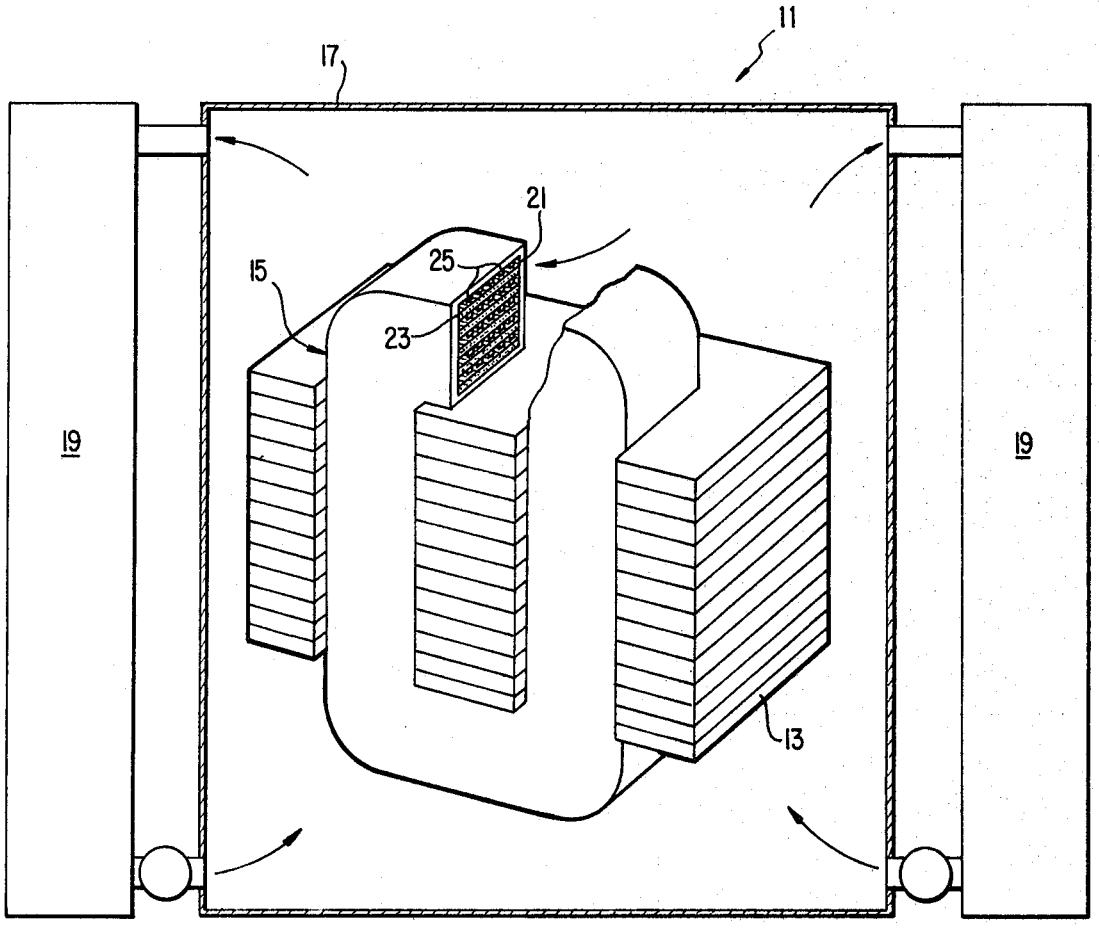
FIG. 5 is a perspective view, partially cut away, of a transformer having a forced oil cooling system which may utilize the teachings of the invention.

FIG. 5 is a perspective view, partially cut away of a transformer 11 of a well-known type which may advantageously utilize the teachings of the invention. Transformer 11 includes a magnetic core 13 about which a coil 15 is wound and which is disposed within a tank 17. The tank 17 is filled with an insulating oil completely immersing the coil 15. Coolers 19 are connected to the tank 17 with the insulating oil circulating therethrough by forced circulation to remove the heat from the insulating oil which is picked up from the coil. The coil 15 comprises a long, flat rectangular strip 21 of electrical conductor. Disposed against one face of the conductor 21 is a matching flat rectangular insulating sheet 23. The two strips 21 and 23 are tightly wound in a spiral thereby forming an annular coil structure 15 which structure is characterized by tightly wound alternate turns of conductor and dielectric. One face of the conductor is scored by grooves 25 collectively forming a plurality of coolant passages distributed throughout the coil structure 15 when the conductor is wound into spiral form. The insulating oil flowing through the groove passages has direct contact with the heat generating surface throughout the passages through the coil 15, and therefore heat is directly transferred to the oil. In accordance with the present invention, the insulating sheet 23 includes particles, fibers or other forms of inorganic material, as described above, for producing a static charge of opposite polarity to that of the charge produced by the base material of the insulating sheet when relative motion between the insulating sheet and the insulating oil takes place as the result of the forced flow of the insulating oil.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. In a transformer having a forced oil cooling system, in combination, an insulating oil forcibly movable in the transformer, and an insulating sheet in contact with the insulating oil and partially covered with an inorganic material, the inorganic material producing a static charge of opposite polarity to the charge produced by the base material of the insulating sheet when relative motion between the insulating sheet and the insulating oil takes place due to forced flow of the insulating oil.

2. In a transformer having a forced oil cooling system, in combination, an insulating oil forcibly movable in the transformer, and an insulating paper in contact with the insulating oil and including inorganic material, the inorganic material producing a negative charge and the insulating paper producing a positive charge when relative motion between the insulating paper and the insulating oil takes place due to force flow of the insulating oil.

3. The tranformer recited in claim 2 wherein the inorganic material is a polyvalent metal oxide, silica or a metal silicate.

4. The transformer rectied in claim 2 wherein the inorganic material is in the form of particles, the particles having an average diameter of 0.1 -100 microns as aggregrated particles under microscope observation and having a true diameter of less than 1 micron as true particles, and wherein the inorganic material is a polyvalent metal oxide, silica or a metal silicate.

5. The transformer recited in claim 2 wherein the inorganic material is a glass fiber or a ceramic fiber.

6. The transformer recited in claim 2 wherein the inorganic material is silica gel, alumina gel or a silicate gel, and is in the form of aggregated particles.

7. The transformer recitd in claim 2 wherein the insulating paper has a surface layer having a higher content of the inorganic material and an inner layer having a lower content of the inorganic material and the surface layer is exposed to the flow of the insulating oil.

8. A method of inhibiting a build-up of charge of static electricity due to the flow of insulating oil in a transformer having a forced oil cooling system which comprises modifying a surface of an insulating paper, by partially disposing thereon an inorganic material placing said modified paper in a transformer having a forced oil cooling system whereby said flow of insulating oil produces a negative charge with said inorganic material and a positive charge with the base material of said paper.

9. A method according to claim 8 wherein the inorganic material is a gel or polyvalent metal oxide, silica or metal silicate in the form of aggregated particles.

10. A method according to claim 8 wherein the inorganic material is a glass fiber or a ceramic fiber.

11. A method according to claim 8 wherein the inorganic material is silica gel, alumina gel or a silicate gel, and is in the form of aggregated particles.

* * * * *